US005595459A

United States Patent [19]

LoMonaco

[11] Patent Number: 5,595,459

[45] Date of Patent: Jan. 21, 1997

[54] COFFERDAM FOR 4', 8' AND 12' DIAMETER TANKS

[76] Inventor: Stenis LoMonaco, 140-28 Springfield Blvd, Queens, N.Y. 11413

[21] Appl. No.: 537,622

[22] Filed: Oct. 2, 1995

[51] Int. Cl.[6] ..... E02D 17/00; E21D 1/00

[52] U.S. Cl. ..... 405/272; 405/133; 405/249; 405/14

[58] Field of Search ..... 405/133, 249, 405/8–10, 11, 14, 272, 274

[56] References Cited

U.S. PATENT DOCUMENTS

| | | | |
|---|---|---|---|
| 81,532 | 8/1868 | Perry | 405/133 |
| 1,143,184 | 6/1915 | Goldsborough | 405/272 |
| 1,296,133 | 11/1917 | Meem | 405/272 |
| 1,775,060 | 9/1930 | Bauer, Jr. | 405/272 |
| 3,727,413 | 4/1973 | Christen | 61/41 A |
| 4,522,532 | 6/1985 | Fedrick | 405/11 |
| 4,657,442 | 4/1987 | Krings | 405/282 |
| 5,131,789 | 7/1992 | Raty | 405/133 X |
| 5,302,054 | 4/1994 | Winkler et al. | 405/274 |

FOREIGN PATENT DOCUMENTS

| | | | |
|---|---|---|---|
| 1182181 | 11/1964 | Germany | 405/133 |

*Primary Examiner*—Tamara L. Graysay
*Assistant Examiner*—Frederick L. Lagman
*Attorney, Agent, or Firm*—Richard L. Miller, P.E.

[57] ABSTRACT

A hole shoring device that includes a support frame, a first hollow octagonal shaped sleeve, a frame linkage, a hollow second octagonal shaped sleeve, a first linkage, a second hollow octagonal shaped sleeve, a second linkage, a third hollow octagonal shaped sleeve, a third linkage, and a fourth hollow octagonal shaped sleeve. The support frame is positioned on an area around a hole in which a tank is to be buried. The first hollow octagonal shaped sleeve is disposed below the support frame and is positioned in the hole. The frame linkage removably connects the first hollow octagonal shaped sleeve and the support frame. The hollow second octagonal shaped sleeve is removably mounted within and extends below the hollow first octagonal shaped sleeve and is positioned in the hole. The first linkage removably connects the hollow second octagonal shaped sleeve and the hollow first octagonal shaped sleeve. The hollow third octagonal shaped sleeve is removably mounted within and extends below the hollow second octagonal shaped sleeve and is positioned in the hole. The second linkage removably connects the hollow third octagonal shaped sleeve and the hollow second octagonal shaped sleeve. The hollow fourth octagonal shaped sleeve is removably mounted within and extends below the hollow third octagonal shaped sleeve and positioned in the hole. And, the third linkage removably connects the hollow fourth octagonal shaped sleeve and the hollow third octagonal shaped sleeve.

19 Claims, 1 Drawing Sheet

FIG. 1
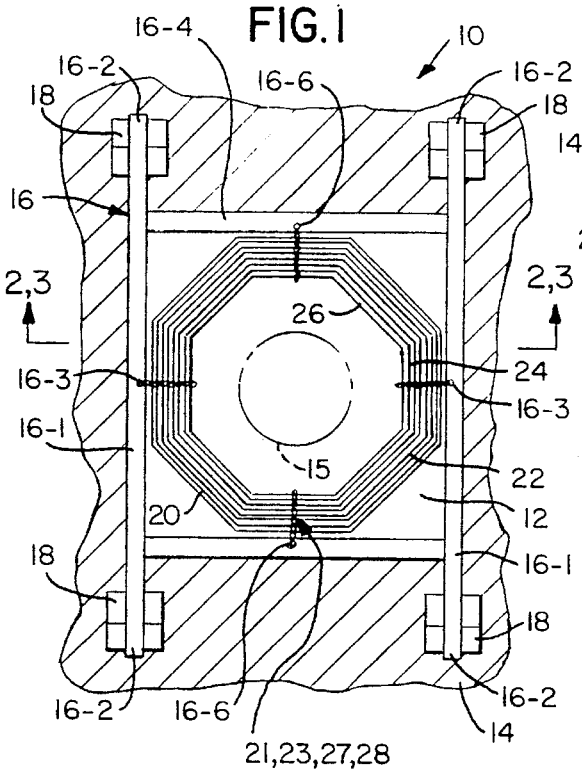
FIG. 2
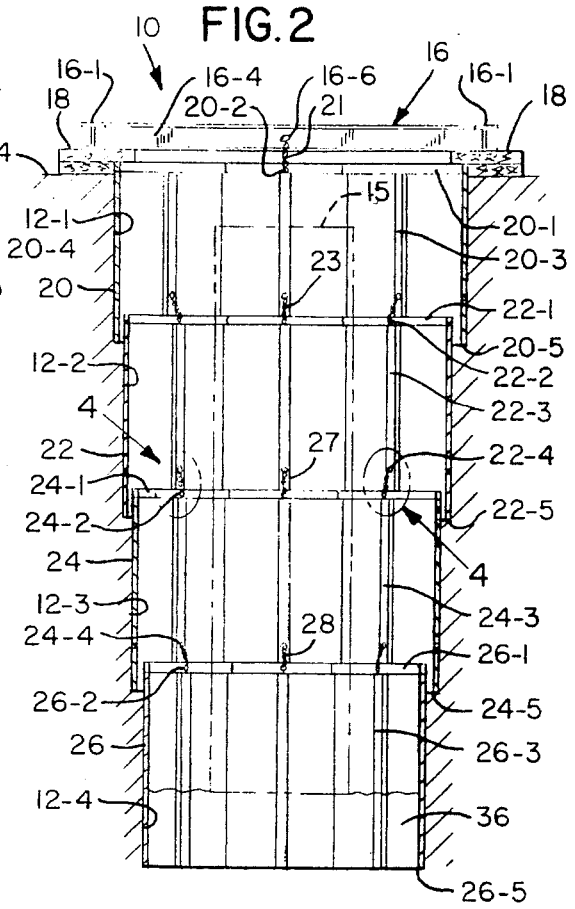
FIG. 3
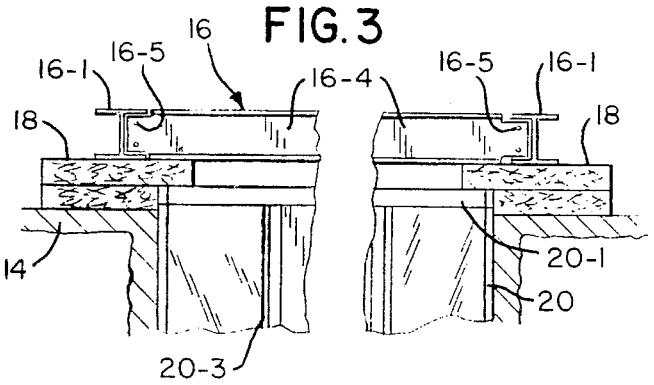
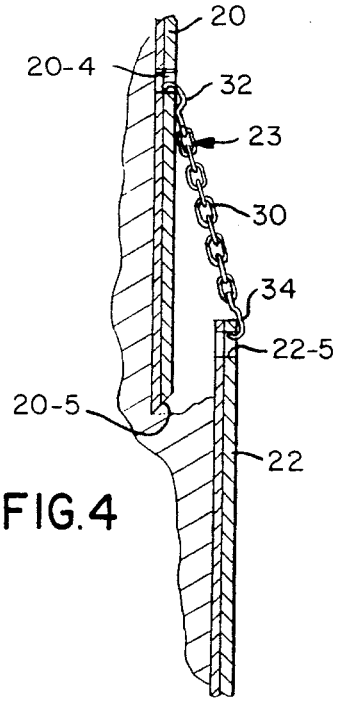
FIG. 4

COFFERDAM FOR 4', 8' AND 12' DIAMETER TANKS

BACKGROUND OF THE INVENTION

The present invention relates to a cofferdam. More particularly, the present invention relates to a hole shoring device that includes a support frame supportable on an area around a hole, a plurality of concentrically disposed hollow octagonal shaped sleeves disposed below the support frame and positionable in the hole wherein each of the plurality of concentrically disposed hollow octagonal shaped sleeves are removably mounted within a previous one of the plurality of concentrically disposed hollow octagonal shaped sleeves and extends downwardly therefrom, linkage removably connects the plurality of the concentrically disposed hollow octagonal shaped sleeves to the frame and to each other.

There are many times on construction projects when a hole needs to be excavated to make room for new underground facilities, such as, underground storage tanks, etc. The vast majority of the time safety regulations issued by groups, such as, OSHA (Occupational Safety and Health Authority) require that excavated holes be shored to prevent their sides from caving in. Upon completion of work within the excavation, the shoring is either removed or abandoned in place. Since the new facility usually supports the permanent earth pressure, the shoring therefore only serves a temporary purpose during construction.

Numerous innovations for cofferdams have been provided in the prior art that will be described. However, even though these innovations may be suitable for the specific individual purposes to which they address, they differ from the present invention in that they do not teach a hole shoring device that includes a support frame supportable on an area around a hole, a plurality of concentrically disposed hollow octagonal shaped sleeves disposed below the support frame and positionable in the hole wherein each of the plurality of concentrically disposed hollow octagonal shaped sleeves are removably mounted within a previous one of the plurality of concentrically disposed hollow octagonal shaped sleeves and extends downwardly therefrom, linkage removably connects the plurality of the concentrically disposed hollow octagonal shaped sleeves to the frame and to each other.

For example, U.S. Pat. No. 3,727,413 to Christen teaches a trench shuttering system that includes a pair of upright posts spaced apart along opposite sides of a trench. Horizontally extending wall elements are received between the posts and the trench. Each of the wall elements include a pair of parallel and relatively slidable members overlapping one another and releasibly secured together by manually operable clamping means at the overlapping junction.

Another example, U.S. Pat. No. 4,522,532 to Fedrick teaches a cofferdam that includes a housing having a bottom opening with a skirt extending about its periphery, first and second seal means being secured to the skirt in spaced-apart relation to form a differential pressure chamber open along its bottom.

Still another example, U.S. Pat. No. 4,657,442 to Krings teaches a cribbing device for trenches which includes a pair of opposing supports spaced apart by a spreader. Each support has a plurality of guide profiles and a crosspiece. The crosspiece is disposed transversely to the longitudinal axis of the trench and the guide profiles are arranged adjacent each other on the crosspiece.

Finally, yet another example, U.S. Pat. No. 5,302,054 to Winkler et al. teaches an excavation hole shoring system that includes a plurality of shoring panels positioned between adjacent vertical soldier beams around the periphery of an excavation hole.

It is apparent that numerous innovations for cofferdams have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a cofferdam that avoids the disadvantages of the prior art.

Another object of the present invention is to provide a cofferdam that is simple and inexpensive to manufacture.

Still another object of the present invention is to provide a cofferdam that is simple to use.

Briefly state, yet another object of the present invention is to provide a cofferdam that includes a support frame, a first hollow octagonal shaped sleeve, a frame linkage, a hollow second octagonal shaped sleeve, a first linkage, a second hollow octagonal shaped sleeve, a second linkage, a third hollow octagonal shaped sleeve, a third linkage, and a fourth hollow octagonal shaped sleeve.

Still yet another object of the present invention is to provide a cofferdam wherein the support frame is positioned on an area around a hole in which a tank is to be buried.

Yet still another object of the present invention is to provide a cofferdam wherein the first hollow octagonal shaped sleeve is disposed below the support frame and is positioned in the hole.

Still yet another object of the present invention is to provide a cofferdam wherein the frame linkage removably connects the first hollow octagonal shaped sleeve and the support frame.

Yet still another object of the present invention is to provide a cofferdam wherein the hollow second octagonal shaped sleeve is removably mounted within and extends below the hollow first octagonal shaped sleeve and is positioned in the hole.

Still yet another object of the present Invention is to provide a cofferdam wherein the first linkage removably connects the hollow second octagonal shaped sleeve and the hollow first octagonal shaped sleeve.

Yet still another object of the present invention is to provide a cofferdam wherein the hollow third octagonal shaped sleeve is removably mounted within and extends below the hollow second octagonal shaped sleeve and is positioned in the hole.

Still yet another object of the present Invention is to provide a cofferdam wherein the second linkage removably connects the hollow third octagonal shaped sleeve and the hollow second octagonal shaped sleeve.

Yet still another object of the present invention is to provide a cofferdam wherein the hollow fourth octagonal shaped sleeve is removably mounted within and extends below the hollow third octagonal shaped sleeve and positioned in the hole.

Still yet another object of the present invention is to provide a cofferdam wherein the third linkage removably connects the hollow fourth octagonal shaped sleeve and the hollow third octagonal shaped sleeve.

Yet still another object of the present invention is to provide a cofferdam wherein the support frame has a pair of support frame spaced apart longitudinal members.

Still yet another object of the present invention is to provide a cofferdam wherein each of the pair of support frame spaced apart longitudinal members has a pair of support frame spaced apart longitudinal member free ends and contains a support frame longitudinal member centrally disposed lift hole.

Yet still another object of the present invention is to provide a cofferdam wherein the support frame further has pair of support frame spaced apart transverse members that intercept the pair of support frame spaced apart longitudinal members inboard of the pair of support frame longitudinal member free ends.

Still yet another object of the present invention is to provide a cofferdam wherein each of the pair of support frame spaced apart transverse members contains a support frame transverse member centrally disposed lift hole.

Yet still another object of the present invention is to provide a cofferdam wherein the octagonal shaped first sleeve has an octagonal shaped first sleeve top plate and a first octagonal shaped sleeve beveled lower cutting edge.

Still yet another object of the present invention is to provide a cofferdam wherein each panel of the octagonal shaped first sleeve top plate contains a first sleeve top plate centrally disposed upper lift hole.

Yet still another object of the present invention is to provide a cofferdam wherein octagonal shaped first sleeve further has a vertically disposed first sleeve guide that is disposed at the center of the inner surface of each panel of the hollow first octagonal shaped sleeve and extends from the octagonal shaped first sleeve top plate to the first octagonal shaped sleeve beveled lower cutting edge.

Still yet another object of the present invention is to provide a cofferdam wherein each of the vertically disposed first sleeve guides contains a first sleeve guide lower lift hole.

Yet still another object of the present invention is to provide a cofferdam wherein the frame linkage has a frame linkage chain with a frame linkage chain upper end and a frame linkage chain lower end, a frame linkage upper J-bolt disposed at said chain upper end, and a lower J-bolt disposed at said frame linkage chain lower end.

Still yet another object of the present invention is to provide a cofferdam wherein the frame linkage upper J-bolt is removably mounted in the support frame longitudinal member centrally disposed lift hole and the support frame transverse member centrally disposed lift hole and the frame linkage lower J-bolt is removably mounted in the first sleeve top plate centrally disposed upper lift hole.

Yet still another object of the present invention is to provide a cofferdam wherein the octagonal shaped second sleeve has an octagonal shaped second sleeve top plate and a second octagonal shaped sleeve beveled lower cutting edge.

Still yet another object of the present invention is to provide a cofferdam wherein each panel of the octagonal shaped second sleeve top plate contains a second sleeve top plate centrally disposed upper lift hole.

Yet still another object of the present invention is to provide a cofferdam wherein the octagonal shaped second sleeve further has a vertically disposed second sleeve guide that is disposed at the center of the inner surface of each panel of the hollow second octagonal shaped sleeve and extends from the octagonal shaped second sleeve top plate to the second octagonal shaped sleeve beveled lower cutting edge.

Still yet another object of the present invention is to provide a cofferdam wherein each of the vertically disposed second sleeve guides contains a second sleeve guide lower lift hole.

Yet still another object of the present invention is to provide a cofferdam wherein the first linkage has a first linkage chain with a first linkage chain upper end and a first linkage chain lower end, a first linkage upper J-bolt disposed at the chain upper end, and a lower J-bolt disposed at the first linkage chain lower end.

Still yet another object of the present invention is to provide a cofferdam wherein the first linkage upper J-bolt is removably mounted in the first sleeve guide lower lift hole and the first linkage lower J-bolt is removably mounted in the second sleeve top plate centrally disposed upper lift hole.

Yet still another object of the present invention is to provide a cofferdam wherein the octagonal shaped third sleeve has an octagonal shaped third sleeve top plate and a third octagonal shaped sleeve beveled lower cutting edge.

Still yet another object of the present invention is to provide a cofferdam wherein each panel of the octagonal shaped third sleeve top plate contains a third sleeve top plate centrally disposed upper lift hole.

Yet still another object of the present invention is to provide a cofferdam wherein the octagonal shaped third sleeve further has a vertically disposed third sleeve guide that is disposed at the center of the inner surface of each panel of the hollow third octagonal shaped sleeve and extends from the octagonal shaped third sleeve top plate to the third octagonal shaped sleeve beveled lower cutting edge.

Still yet another object of the present invention is to provide a cofferdam wherein each of the vertically disposed third sleeve guides contains a third sleeve guide lower lift hole.

Yet still another object of the present invention is to provide a cofferdam wherein the second linkage has a second linkage chain with a second linkage chain upper end and a second linkage chain lower end, a second linkage upper J-bolt disposed at said second linkage chain upper end, and a second linkage lower J-bolt disposed at said second linkage chain lower end.

Still yet another object of the present invention is to provide a cofferdam wherein the second linkage upper J-bolt is removably mounted in the second sleeve guide lower lift hole and the second linkage lower J-bolt is removably mounted in the third sleeve top plate centrally disposed upper lift hole.

Yet still another object of the present invention is to provide a cofferdam wherein the octagonal shaped fourth sleeve has an octagonal shaped fourth sleeve top plate and a fourth octagonal shaped sleeve beveled lower cutting edge.

Still yet another object of the present invention is to provide a cofferdam wherein each panel of the octagonal shaped fourth sleeve top plate contains a fourth sleeve top plate centrally disposed upper lift hole.

Yet still another object of the present invention is to provide a cofferdam wherein the octagonal shaped fourth sleeve further has a vertically disposed fourth sleeve guide that is disposed at the center of the inner surface of each panel of said hollow fourth octagonal shaped sleeve and extends from the octagonal shaped fourth sleeve top plate to the fourth octagonal shaped sleeve beveled lower cutting edge.

Still yet another object of the present invention is to provide a cofferdam wherein the third linkage has a third linkage chain with a third linkage chain upper end and a third linkage chain lower end, a third linkage upper J-bolt disposed at said third linkage chain upper end, and a third linkage lower J-bolt disposed at said third linkage chain lower end.

Yet still another object of the present invention is to provide a cofferdam wherein the third linkage upper J-bolt is removably mounted in the third sleeve guide lower lift hole and the third linkage lower J-bolt is removably mounted in the fourth sleeve top plate centrally disposed upper lift hole.

Still yet another object of the present invention is to provide a cofferdam that further includes cribs disposed under the pair of support frame spaced apart longitudinal member free ends.

Yet still another object of the present invention is to provide a method of using a cofferdam that includes the steps of excavating a pilot hole to a depth of 5', installing a crib on an area outside the pilot hole, installing a support frame on the crib, setting a hollow first octagonal shaped sleeve in the pilot hole, lowering the hollow first octagonal shaped sleeve to a depth of 5.33', connecting a frame linkage arrangement to the support frame and the hollow first octagonal shaped sleeve, setting a hollow second octagonal shaped sleeve inside the hollow first octagonal shaped sleeve, excavating a second sleeve hole below the pilot hole, lowering the hollow second octagonal shaped sleeve into the second sleeve hole to a depth of 10.33', connecting a first linkage arrangement to the hollow first octagonal shaped sleeve and the hollow second octagonal shaped sleeve, setting a hollow third octagonal shaped sleeve inside the hollow second octagonal shaped sleeve, excavating a third sleeve hole below the second sleeve hole, lowering a hollow third octagonal shaped sleeve into the third sleeve hole to a depth of 15.33', connecting a second linkage arrangement to the hollow second octagonal shaped sleeve and the hollow third octagonal shaped sleeve, setting a hollow fourth octagonal shaped sleeve inside the hollow third octagonal shaped sleeve, excavating a fourth sleeve hole below the third sleeve hole, lowering the hollow fourth octagonal shaped sleeve into the fourth sleeve hole to a depth of 20.33', connecting a third linkage arrangement to the hollow third octagonal shaped sleeve and the hollow fourth octagonal shaped sleeve, installing a filter fabric to the top of the hollow fourth octagonal shaped sleeve with a 9" overlap, installing gravel, a bottom slab, and a drain ring section in the hollow octagonal shaped sleeve to a height of 2', and positioning a tank in the excavation.

Finally, yet still another object of the present invention is to provide a method of using a cofferdam that further includes the steps of removing the third linkage arrangement from the hollow third octagonal shaped sleeve and the hollow fourth octagonal shaped sleeve, removing the hollow fourth octagonal shaped sleeve from the fourth sleeve hole, removing the second linkage arrangement from the hollow second octagonal shaped sleeve and the hollow third octagonal shaped sleeve, removing the hollow third octagonal shaped sleeve from the third sleeve hole, removing the first linkage arrangement from the hollow first octagonal shaped sleeve and the hollow second octagonal shaped sleeve, removing the hollow second octagonal shaped sleeve from the second sleeve hole, removing the frame linkage arrangement from the support frame and the hollow first octagonal shaped sleeve, removing the hollow first octagonal shaped sleeve from the first sleeve hole, removing the support frame from the crib, removing the crib from the area outside the pilot hole, installing completely a manhole frame and a cover, and backfilling to original ground level as per D.E.P. Sewer Design Specifications.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic top plan view of the instant invention installed at a typical excavation construction site;

FIG. 2 is a diagrammatic cross sectional view taken along line 2—2 of FIG. 1;

FIG. 3 is an enlarged diagrammatic cross sectional view with parts broken away showing the support frame and crib in greater detail; and FIG. 4 is an enlarged diagrammatic view of the area enclosed in the dotted circle indicated by arrow 4 of FIG. 2.

LIST OF REFERENCE NUMERALS UTILIZED IN THE DRAWING

10 cofferdam of the present invention

12 hole

14 ground

12-1 first sleeve hole

12-2 second sleeve hole

12-3 third sleeve hole

12-4 fourth sleeve hole

15 tank

16 support frame

16-1 pair of support frame spaced apart longitudinal members

16-2 pair of support frame spaced apart longitudinal member free ends

16-3 support frame longitudinal member centrally disposed lift hole

16-4 pair of support frame spaced apart transverse members

16-6 support frame transverse member centrally disposed lift hole

18 crib

20 hollow first octagonal shaped sleeve

20-1 octagonal shaped first sleeve top plate

20-2 first sleeve top plate centrally disposed upper lift hole

20-3 vertically disposed first sleeve guide

20-4 first sleeve guide lower lift hole

20-5 first octagonal shaped sleeve beveled lower cutting edge

21 frame linkage arrangement

22 hollow second octagonal shaped sleeve

22-1 octagonal shaped second sleeve top plate

22-2 second sleeve top plate centrally disposed upper lift hole

22-3 vertically disposed second sleeve guide

22-2 second sleeve guide lower lift hole

24 first linkage arrangement 24

22-5 second octagonal shaped sleeve beveled lower cutting edge

24 hollow third octagonal shaped sleeve

24-1 third octagonal shaped sleeve top plate

24-2 third sleeve top plate centrally disposed upper lift hole

24-3 vertically disposed third sleeve guide

24-4 third sleeve guide lower lift hole 24-4

24-5 third octagonal shaped sleeve beveled lower cutting edge

26 hollow fourth octagonal shaped sleeve

26-1 fourth octagonal shaped sleeve top plate

26-2 third sleeve top plate centrally disposed upper lift hole

26-3 vertically disposed fourth sleeve guide

26-5 fourth octagonal shaped sleeve beveled lower cutting edge

27 second linkage arrangement

28 fourth linkage arrangement

30 first linkage chain

32 first linkage upper J-bolt

34 first linkage lower J-bolt

36 gravel

DETAILED DESCRIPTION OF THE PREFERRED EMBODIMENT

Referring now to the figures in which like numerals indicate like parts, and particularly to FIG. 1, the cofferdam of the present invention is shown generally at 10 operating at a hole 12 in ground 14 in which a tank 15 is disposed. The tank 15 can typically be 4' in diameter.

The overall configuration of the cofferdam 10 can best be seen in FIGS. 1, 2 and 3, and as such, will be discussed with reference thereto.

It should be understood that the dimensions and materials presented are for illustrative purposes only and that different dimensions and materials may be used.

The cofferdam 10 includes a support frame 16 that surrounds the hole 12. The support frame 16 has a pair of support frame spaced apart longitudinal members 16-1 disposed outboard of the hole 12 and may typically be steel W8×28 "I" beams of 18'-2" lengths.

Each of the pair of support frame spaced apart longitudinal members 16-1 have a pair of support frame spaced apart longitudinal member free ends 16-2 and contains a support frame longitudinal member centrally disposed lift hole 16-3 which may typically be 2" in diameter.

A pair of support frame spaced apart transverse members 16-4 are disposed outboard of the hole 12 and intercept each of the pair of support frame spaced apart longitudinal members 16-1 at least 4' inboard of each of the pair of support frame longitudinal member free ends 16-2.

The pair of support frame spaced apart transverse members 16-3 may typically be steel W8×28 "I" beams and may be attached to the pair of support frame spaced apart longitudinal members 16-1 by frame bolts 16-5, via ⅜" plates (not shown), for easy field erection. The frame bolts may typically be ¾" in diameter.

Each of the pair of support frame spaced apart transverse members 16-4 contains a support frame transverse member centrally disposed lift hole 16-6 which typically may be 2" in diameter.

A crib 18 is disposed under and supports each pair of support frame longitudinal member free ends 16-2 and rests on the ground 14. Each crib 18 may typically be four 4"×12"×2' timbers, two being side by side and being stacked two high.

The hole 12 has a first sleeve hole 12-1 which may typically be 5.33' deep and 10' wide. A hollow first octagonal shaped sleeve 20 is disposable in the first sleeve hole 12-1. The hollow first hollow octagonal shaped sleeve 20 may typically be ⅝" steel, and have an inside diameter of 9'-9¾" and a height of 5'-6". To assist in the placement and retention of the hollow first octagonal shaped sleeve 20 in the first sleeve hole 12-1, a first octagonal shaped sleeve beveled lower cutting edge 20-5 is provided.

An octagonal shaped first sleeve top plate 20-1, which may typically be 3"×1" steel, is disposed at the top of the hollow first octagonal shaped sleeve 20 and may typically be welded thereto by ¾" diameter plug welds at 1' intervals. Each panel of the octagonal shaped first sleeve top plate 20-1 contains a first sleeve top plate centrally disposed upper lift hole 20-2 which may typically be 2" in diameter.

A vertically disposed first sleeve guide 20-3, which may typically be 3"×1" steel, is disposed at the center of the inner surface of each of the panels of the hollow first octagonal shaped sleeve 20 and extends from the octagonal shaped first sleeve top plate 20-1 to the first octagonal shaped sleeve beveled lower cutting edge 20-5. The vertically disposed first sleeve guides 20-3 may typically be welded to the hollow first octagonal shaped sleeve 20 by ¾" diameter plug welds at 1' intervals.

Each of the vertically disposed first sleeve guides 20-3 contain a first sleeve guide lower lift hole 20-4 which may typically be 2" in diameter and disposed 2'-1" from the first octagonal shaped sleeve beveled lower cutting edge 20-5.

The hollow first octagon shaped sleeve 22 is removably mounted to the support frame 16 by a frame linkage arrangement 21.

The hole 12 has a second sleeve hole 12-2 that is disposed below the first sleeve hole 12-1 and may typically be 5' deep and 9.3' wide. A hollow second octagonal shaped sleeve 22 is movably disposed in the hollow first octagon shaped sleeve 20 and is extendable downwardly therefrom. The hollow second octagonal shaped sleeve 22 may typically be ⅝" steel, has an inside diameter of 9'-2½" and a height of 5'-6", and may extend 5' below the hollow first octagon shaped sleeve 20 when extended. To assist in the placement and retention of the hollow second octagonal shaped sleeve 22 in the second sleeve hole 12-2, a second octagonal shaped sleeve beveled lower cutting edge 22-5 is provided.

An octagonal shaped second sleeve top plate 22-1, which may typically be 3"×1"60 steel, is disposed at the top of the hollow second octagonal shaped sleeve 22 and may typically be welded thereto by ¾" diameter plug welds at 1' intervals. Each panel of the octagon shaped second sleeve top plate 22-1 contains a second sleeve top plate centrally disposed upper lift hole 22-2 which may typically be 2" in diameter. When the hollow second octagonal shaped sleeve 22 is extended, the second sleeve top plate centrally disposed upper lift holes 22-2 may typically be 1'-6" below the first sleeve guide lower lift holes 20-4.

A vertically disposed second sleeve guide 22-3, which may typically be 3"×1" steel, is disposed at the center of the inner surface of each of the panels of the hollow second octagonal shaped sleeve 22 and extends from the octagonal shaped second sleeve top plate 22-1 to the second octagonal shaped sleeve beveled lower cutting edge 22-5. The vertically disposed second sleeve guides 22-3 may typically be welded to the hollow second octagonal shaped sleeve 22 by ¾" diameter plug welds at 1' intervals.

Each of the vertically disposed second sleeve guides 22-3 contains a second sleeve guide lower lift hole 22-4 which may typically be 2" in diameter and disposed 2'-1" from the second octagonal shaped sleeve beveled lower cutting edge 22-5.

The hollow second octagon shaped sleeve 22 is removably mounted within the hollow first octagon shaped sleeve 20 by a first linkage arrangement 24.

The hole 12 has a third sleeve hole 12-3 that is disposed below the second sleeve hole 12-2 and may typically be 5' deep and 8.75' wide. A hollow third octagonal shaped sleeve 24 is movably disposed in the hollow second octagon shaped sleeve 22 and extends downwardly therefrom. The hollow third octagonal shaped sleeve 24 may typically be ⅝" steel, has an inside diameter of 8'-7¼" and a height of 5'-6", and may extend 5' below the hollow second octagon shaped sleeve 22 when extended. To assist in the placement and retention of the third octagonal shaped sleeve 24 in the third sleeve hole 12-3, a third octagonal shaped sleeve beveled lower cutting edge 24-5 is provided.

A third octagonal shaped sleeve top plate 24-1, which may typically be 3"×1" steel, is disposed at the top of the hollow third octagonal shaped sleeve 24 and may typically be welded thereto by ¾" diameter plug welds at 1' intervals. Each side of the third octagonal shaped sleeve top plate 24-1 contains a third sleeve top plate centrally disposed upper lift hole 24-2 which may typically be 2" in diameter. When the hollow third octagonal shaped sleeve 24 is extended, the third sleeve top plate centrally disposed upper lift holes 24-2 may typically be 1'-6" below the second sleeve guide lower lift holes 22-4.

A vertically disposed third sleeve guide 24-3, which may typically be 3"×1" steel, is disposed at the center of the inner surface of each of the panels of the hollow third octagonal shaped sleeve 24 and extends from the octagonal shaped third sleeve top plate 24-1 to the third octagonal shaped sleeve beveled lower cutting edge 24-5. The vertically disposed third sleeve guides 24-3 may typically be welded thereto by ¾" diameter plug welds at 1' intervals.

Each of the vertically disposed second sleeve guides 24-3 contains a third sleeve guide lower lift hole 24-4 which may typically be 2" in diameter and disposed 2'-1" from the bottom of the hollow third octagonal shaped sleeve 22.

The hollow third octagon shaped sleeve 24 is removably mounted within the hollow second octagon shaped sleeve 22 by a second linkage arrangement 27.

The hole 12 has a fourth sleeve hole 12-4 that is disposed below the third sleeve hole 12-3 and may typically be 5' deep and 8.2' wide. A hollow fourth octagonal shaped sleeve 26 is movably disposed in the hollow third octagon shaped sleeve 24 and extends downwardly therefrom. The hollow fourth octagonal shaped sleeve 26 may typically be ⅝" steel, has an inside diameter of 8' and a height of 5'-6", and may extend 5' below the hollow third octagon shaped sleeve 24 when extended. To assist in the placement and retention of the hollow fourth octagonal shaped sleeve 26 in the fourth sleeve hole 12-4, a fourth octagonal shaped sleeve beveled lower cutting edge 26-5 is provided.

A fourth octagonal shaped sleeve top plate 26-1, which may typically be 3"×1" steel, is disposed at the top of the hollow fourth octagonal shaped sleeve 26 and may typically be welded thereto by ¾" diameter plug welds at 1' intervals. Each side of the fourth octagonal shaped sleeve top plate 26-1 contains a third sleeve top plate centrally disposed upper lift hole 26-2 which may typically be 2" in diameter. When the hollow fourth octagonal shaped sleeve 26 is extended, the fourth sleeve top plate centrally disposed upper lift holes 26-2 may typically be 1'-6" below the third sleeve guide lower lift holes 22-4.

A vertically disposed fourth sleeve guide 26-3, which may typically be 3"×1" steel, is disposed at the center of the inner surface of each of the panels of the hollow fourth octagonal shaped sleeve 26 and extends from the octagonal shaped fourth sleeve top plate 26-1 to the fourth octagonal shaped sleeve beveled lower cutting edge 26-5. The vertically disposed fourth sleeve guides 26-3 may typically be welded thereto by ¾" diameter plug welds at 1' intervals.

The hollow fourth octagon shaped sleeve 26 is removably mounted within the hollow third octagon shaped sleeve 24 by a fourth linkage arrangement 28.

It is to be understood that the configuration and operation of the frame linkage arrangement 21, the first linkage arrangement 23, the second linkage arrangement 27, and the third linkage arrangement 28 are identical therefore making a discussion of the frame linkage arrangement 21, the second linkage arrangement 27, and the third linkage arrangement 28 needless in view of a discussion of the first linkage arrangement 23.

The configuration of the first linkage arrangement 23 can best be seen in FIG. 4, and as such, will be discussed with reference thereto.

The first linkage arrangement 23 includes a first linkage chain 30 which may typically be 8 KIP capacity. A first linkage upper J-bolt 32 is affixed to the upper end of the first linkage chain 30 and is removably mounted in the first sleeve guide lower lift holes 20-4. A first linkage lower J-bolt 34 is affixed to the lower end of the first linkage chain 30 and is removably mounted in the second sleeve top plate centrally disposed upper lift holes 22-2.

In the case of the frame linkage arrangement 21, however, the upper J-bolt 32 is removably mounted in the support frame longitudinal member centrally disposed lift holes 16-3 and the support frame transverse member centrally disposed lift holes 16-6.

The operation of the cofferdam 10 can best be seen in FIGS. 1 and 2, and as such, will be discussed with reference thereto.

1. A pilot hole (not shown) is excavated to a depth of 5' in the ground 14 at the point where the tank 15 is to be buried;
2. The crib 18 is installed on the ground 14 outside the hole 12;
3. The support frame 16 is installed on the crib 18;
4. The hollow first octagonal shaped sleeve 20 is set in the pilot hole (not shown);
5. The hollow first octagonal shaped sleeve 20 is lowered to a depth of 5.33';
6. The frame linkage arrangement 21 is connected to the support frame 16 and the hollow first octagonal shaped sleeve 20;

7. The hollow second octagonal shaped sleeve 22 is set inside the hollow first octagonal shaped sleeve 20;

8. The second sleeve hole 12-2 is excavated below the first sleeve hole 12-1;

9. The hollow second octagonal shaped sleeve 22 is lowered into the second sleeve hole 12-2 to a depth of 10.33';

10. The first linkage arrangement 24 is connected to the hollow first octagonal shaped sleeve 20 and the hollow second octagonal shaped sleeve 22;

11. The hollow third octagonal shaped sleeve 24 is set inside the hollow second octagonal shaped sleeve 22;

12. The third sleeve hole 12-3 is excavated below the second sleeve hole 12-2;

13. The hollow third octagonal shaped sleeve 24 is lowered into the third sleeve hole 12-3 to a depth of 15.33';

14. The second linkage arrangement 26 is connected to the hollow second octagonal shaped sleeve 22 and the hollow third octagonal shaped sleeve 24;

15. The hollow fourth octagonal shaped sleeve 26 is set inside the hollow third octagonal shaped sleeve 24;

16. The fourth sleeve hole 12-4 is excavated below the third sleeve hole 12-3;

17. The hollow fourth octagonal shaped sleeve 26 is lowered into the fourth sleeve hole 12-4 to a depth of 20.33';

18. The third linkage arrangement 28 is connected to the hollow third octagonal shaped sleeve 24 and the hollow fourth octagonal shaped sleeve 26;

19. A filter fabric (not shown) is installed to the top of the hollow fourth octagonal shaped sleeve 26 with a 9" overlap;

20. Gravel 36, a bottom slab (not shown), and a drain ring section (not shown) are installed in the hollow octagonal shaped sleeve to a height of 2';

21. The tank 15 is positioned in the hole 12;

22. The third linkage arrangement 28 is removed from the hollow third octagonal shaped sleeve 24 and the hollow fourth octagonal shaped sleeve 26;

23. The hollow fourth octagonal shaped sleeve 26 is removed from the fourth sleeve hole 12-4;

24. The second linkage arrangement 26 is removed from the hollow second octagonal shaped sleeve 22 and the hollow third octagonal shaped sleeve 24;

25. The hollow third octagonal shaped sleeve 24 is removed from the third sleeve hole 12-3;

26. The first linkage arrangement 24 is removed from the hollow first octagonal shaped sleeve 20 and the hollow second octagonal shaped sleeve 22;

27. The hollow second octagonal shaped sleeve 22 is removed from the second sleeve hole 12-2;

28. The frame linkage arrangement 21 is removed from the support frame 16 and the hollow first octagonal shaped sleeve 20;

29. The hollow first octagonal shaped sleeve 20 is removed from the first sleeve hole 12-1;

30. The support frame 16 is removed from the crib 18;

31. The crib 18 is removed from the ground 14 outside the hole 12;

32. The manhole frame (not shown) and cover (not shown) are completely installed; and 33. The hole 12 is backfilled to the original ground level as per D.E.P. Sewer Design Specifications.

It will be understood that each of the elements described above, or two or more together, may also find a useful application in other types of constructions differing from the types described above.

While the invention has been illustrated and described as embodied in a cofferdam, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hole shoring device, comprising:

a) a support frame supportable on an area around a hole;

b) a first hollow octagonal shaped sleeve disposed below said support frame and positionable in the hole;

c) a frame linkage removably connecting said first hollow octagonal shaped sleeve and said support frame;

d) a hollow second octagonal shaped sleeve removably mounted within and extending below said hollow first octagonal shaped sleeve and positionable in the hole;

e) a first linkage removably connecting said hollow second octagonal shaped sleeve and said hollow first octagonal shaped sleeve;

f) a hollow third octagonal shaped sleeve removably mounted within and extending below said hollow second octagonal shaped sleeve and positionable in the hole;

g) a second linkage removably connecting said hollow third octagonal shaped sleeve and said hollow second octagonal shaped sleeve;

h) a hollow fourth octagonal shaped sleeve removably mounted within and extendable below said hollow third octagonal shaped sleeve and positionable in the hole; and i) a third linkage removably connecting said hollow fourth octagonal shaped sleeve and said hollow third octagonal shaped sleeve.

2. The device as defined in claim 1, wherein said support frame has a pair of support frame spaced apart longitudinal members, each of said pair of support frame spaced apart longitudinal members has a pair of support frame spaced apart longitudinal member free ends and contains a support frame longitudinal member centrally disposed lift hole.

3. The device as defined in claim 2, wherein said support frame further has pair of support frame spaced apart transverse members that intercept said pair of support frame spaced apart longitudinal members inboard of said pair of support frame longitudinal member free ends, each of said pair of support frame spaced apart transverse members contains a support frame transverse member centrally disposed lift hole.

4. The device as defined in claim 3, wherein said octagonal shaped first sleeve has an octagonal shaped first sleeve top plate and a first octagonal shaped sleeve beveled lower cutting edge, each panel of said octagonal shaped first sleeve top plate contains a first sleeve top plate centrally disposed upper lift hole.

5. The device as defined in claim 4, wherein said octagonal shaped first sleeve further has a vertically disposed first sleeve guide that is disposed at the center of the inner surface of said each panel of said hollow first octagonal shaped sleeve and extends from said octagonal shaped first sleeve top plate to said first octagonal shaped sleeve beveled lower cutting edge, each of said vertically disposed first sleeve guides contains a first sleeve guide lower lift hole.

6. The device as defined in claim 5, wherein said frame linkage has a frame linkage chain with a frame linkage chain upper end and a frame linkage chain lower end, a frame linkage upper J-bolt disposed at said chain upper end, and a lower J-bolt disposed at said frame linkage chain lower end, said frame linkage upper J-bolt is removably mounted in said support frame longitudinal member centrally disposed lift hole and said support frame transverse member centrally disposed lift hole and said frame linkage lower J-bolt is removably mounted in said first sleeve top plate centrally disposed upper lift hole.

7. The device as defined in claim 2; further comprising cribs disposed under said pair of support frame spaced apart longitudinal member free ends.

8. The device as defined in claim 1, wherein said octagonal shaped second sleeve has an octagonal shaped second sleeve top plate and a second octagonal shaped sleeve beveled lower cutting edge, each panel of said octagonal shaped second sleeve top plate contains a second sleeve top plate centrally disposed upper lift hole.

9. The device as defined in claim 8, wherein said octagonal shaped second sleeve further has a vertically disposed second sleeve guide that is disposed at the center of the inner surface of each panel of said hollow second octagonal shaped sleeve and extends from said octagonal shaped second sleeve top plate to said second octagonal shaped sleeve beveled lower cutting edge, each of said vertically disposed second sleeve guides contains a second sleeve guide lower lift hole.

10. The device as defined in claim 9, wherein said first linkage has a first linkage chain with a first linkage chain upper end and a first linkage chain lower end, a first linkage upper J-bolt disposed at said chain upper end, and a lower J-bolt disposed at said first linkage chain lower end, said first linkage upper J-bolt is removably mounted in said first sleeve guide lower lift hole and said first linkage lower J-bolt is removably mounted in said second sleeve top plate centrally disposed upper lift hole.

11. The device as defined in claim 1, wherein said octagonal shaped third sleeve has an octagonal shaped third sleeve top plate and a third octagonal shaped sleeve beveled lower cutting edge, each panel of said octagonal shaped third sleeve top plate contains a third sleeve top plate centrally disposed upper lift hole.

12. The device as defined in claim 11, wherein said octagonal shaped third sleeve further has a vertically disposed third sleeve guide that is disposed at the center of the inner surface of each panel of said hollow third octagonal shaped sleeve and extends from said octagonal shaped third sleeve top plate to said third octagonal shaped sleeve beveled lower cutting edge, each of said vertically disposed third sleeve guides contains a third sleeve guide lower lift hole.

13. The device as defined in claim 12, wherein said second linkage has a second linkage chain with a second linkage chain upper end and a second linkage chain lower end, a second linkage upper J-bolt disposed at said second linkage chain upper end, and a second linkage lower J-bolt disposed at said second linkage chain lower end, said second linkage upper J-bolt is removably mounted in said second sleeve guide lower lift hole and said second linkage lower J-bolt is removably mounted in said third sleeve top plate centrally disposed upper lift hole.

14. The device as defined in claim 1, wherein said octagonal shaped fourth sleeve has an octagonal shaped fourth sleeve top plate and a fourth octagonal shaped sleeve beveled lower cutting edge, each panel of said octagonal shaped fourth sleeve top plate contains a fourth sleeve top plate centrally disposed upper lift hole.

15. The device as defined in claim 14, wherein said octagonal shaped fourth sleeve further has a vertically disposed fourth sleeve guide that is disposed at the center of the inner surface of said each panel of said hollow fourth octagonal shaped sleeve and extends from said octagonal shaped fourth sleeve top plate to said fourth octagonal shaped sleeve beveled lower cutting edge.

16. The device as defined in claim 15, wherein said third linkage has a third linkage chain with a third linkage chain upper end and a third linkage chain lower end, a third linkage upper J-bolt disposed at said third linkage chain upper end, and a third linkage lower J-bolt disposed at said third linkage chain lower end, said third linkage upper J-bolt is removably mounted in said third sleeve guide lower lift hole and said third linkage lower J-bolt is removably mounted in said fourth sleeve top plate centrally disposed upper lift hole.

17. A hole shoring device, comprising:

a) a support frame supportable on an area around a hole;

b) a plurality of concentrically disposed hollow octagonal shaped sleeves disposed below said support frame and positionable in the hole, each of said plurality of concentrically disposed hollow octagonal shaped sleeves being removably mounted within a previous one of said plurality of concentrically disposed hollow octagonal shaped sleeves and extending downwardly therefrom; and c) linkage removably connecting said plurality of said concentrically disposed hollow octagonal shaped sleeves to said frame and to each other.

18. A method of using a hole shoring device, comprising the steps of:

a) excavating a pilot hole to a depth of 5';

b) installing a crib of said hole shoring device on an area outside said pilot hole;

c) installing a support frame of said hole shoring device on said crib;

d) setting a hollow first octagonal shaped sleeve of said hole shoring device in said pilot hole;

e) lowering said hollow first octagonal shaped sleeve to a depth of 5.33';

f) connecting a frame linkage arrangement of said hole shoring device to said support frame and said hollow first octagonal shaped sleeve;

g) setting a hollow second octagonal shaped sleeve of said hole shoring device inside said hollow first octagonal shaped sleeve;

h) excavating a second sleeve hole below said pilot hole;

i) lowering said hollow second octagonal shaped sleeve into said second sleeve hole to a depth of 10.33';

j) connecting a first linkage arrangement of said hole shoring device to said hollow first octagonal shaped sleeve and said hollow second octagonal shaped sleeve;

k) setting a hollow third octagonal shaped sleeve of said hole shoring device inside said hollow second octagonal shaped sleeve;

l) excavating a third sleeve hole below said second sleeve hole;

m) lowering a hollow third octagonal shaped sleeve of said hole shoring device into said third sleeve hole to a depth of 15.33';

n) connecting a second linkage arrangement of said hole shoring device to said hollow second octagonal shaped sleeve and said hollow third octagonal shaped sleeve;

o) setting a hollow fourth octagonal shaped sleeve of said hole shoring device inside said hollow third octagonal shaped sleeve;

p) excavating a fourth sleeve hole below said third sleeve hole;

q) lowering said hollow fourth octagonal shaped sleeve into the fourth sleeve hole to a depth of 20.33';

r) connecting a third linkage arrangement of said hole shoring device to said hollow third octagonal shaped sleeve and said hollow fourth octagonal shaped sleeve;

s) installing a filter fabric to the top of said hollow fourth octagonal shaped sleeve with a 9" overlap;

t) installing gravel, a bottom slab, and a drain ring section in said hollow octagonal shaped sleeve to a height of 2'; and u) positioning a tank in said excavation.

19. The method as defined in claim 18; further comprising the steps of:

a) removing said third linkage arrangement from said hollow third octagonal shaped sleeve and said hollow fourth octagonal shaped sleeve;

b) removing said hollow fourth octagonal shaped sleeve from said fourth sleeve hole;

c) removing said second linkage arrangement from said hollow second octagonal shaped sleeve and said hollow third octagonal shaped sleeve;

d) removing said hollow third octagonal shaped sleeve from said third sleeve hole;

e) removing said first linkage arrangement from said hollow first octagonal shaped sleeve and said hollow second octagonal shaped sleeve;

f) removing said hollow second octagonal shaped sleeve from said second sleeve hole;

g) removing said frame linkage arrangement from said support frame and said hollow first octagonal shaped sleeve;

h) removing said hollow first octagonal shaped sleeve from said first sleeve hole;

i) removing said support frame from said crib;

j) removing said crib from said area outside said pilot hole;

k) installing completely a manhole frame and a cover; and l) backfilling to original ground level as per D.E.P. Sewer Design Specifications.

* * * * *